US006915666B2

(12) United States Patent
Willmer

(10) Patent No.: US 6,915,666 B2
(45) Date of Patent: Jul. 12, 2005

(54) CIRCULAR KNITTING MACHINE, ESPECIALLY FOR THE PRODUCTION OF SPACER FABRICS

(75) Inventor: Rolf Willmer, Albstadt (DE)

(73) Assignee: SIPRA Patententwicklungs- und Beteiligungsgesellschaft mbH, Albstadt (DE)

( * ) Notice: Subject to any disclaimer, the term of this patent is extended or adjusted under 35 U.S.C. 154(b) by 0 days.

(21) Appl. No.: 10/835,782

(22) Filed: Apr. 30, 2004

(65) Prior Publication Data

US 2004/0216496 A1 Nov. 4, 2004

(30) Foreign Application Priority Data

May 2, 2003 (DE) ..... 103 20 533

(51) Int. Cl.[7] ..... D04B 9/06
(52) U.S. Cl. ..... 66/19
(58) Field of Search ..... 66/8, 17, 19, 20, 66/21, 22, 23, 24, 25, 26, 27, 28

(56) References Cited

U.S. PATENT DOCUMENTS

| | | | | |
|---|---|---|---|---|
| 1,385,929 A | | 7/1921 | Scott | |
| RE15,741 E | | 1/1924 | Scott | |
| 2,250,658 A | | 7/1941 | Smith et al. | |
| 4,920,767 A | * | 5/1990 | Plath et al. | 66/13 |
| 5,275,020 A | * | 1/1994 | Scherzinger | 66/27 |
| 2002/0152776 A1 | | 10/2002 | Didier | |

FOREIGN PATENT DOCUMENTS

| | | |
|---|---|---|
| DE | 74 25 934 | 11/1974 |
| DE | 27 11 881 | 9/1977 |
| DE | 28 50 823 | 5/1979 |
| DE | 28 21 214 | 11/1979 |
| DE | 31 40 787 A1 | 4/1983 |
| DE | 38 21 213 A1 | 2/1989 |
| DE | 41 28 372 A1 | 3/1993 |
| GB | 1 571 584 | 7/1980 |

* cited by examiner

*Primary Examiner*—Danny Worrell
(74) *Attorney, Agent, or Firm*—Michael J. Striker

(57) ABSTRACT

A circular knitting machine is described which is intended to serve in particular the production of spacer fabrics. The circular knitting machine contains a needle cylinder (1) having cylinder needles (2), a cylinder cam (3), a dial (4) with needles (5) and a dial cam (6). The needle cylinder (1) and the dial (4) fix a vertical and a horizontal comb spacing (x, y) and a stitch spacing (z). According to the invention, the needle cylinder (1) and the dial (4) are set up to form a stitch spacing (z) of at least 6 mm, and the knitting needles (2, 5) of the needle cylinder (1) and/or the dial (4) are in the form of compound needles (FIG. 1).

6 Claims, 7 Drawing Sheets

5
5b
5a
16.1
16
15.2
15.1
20
15.5
15.4
15.3
15
2
20.1
22
S1
19
18
IV
20.2
21
20.3

24
S2
18.1
18.2
V
V
19.1
25
18.3
VI
VII
20.4
19.2
14
S3
18.5
18.4
20.5
20.6
19.3
VIII
11
IX
X
XI
18.6
19.4

Fig.4.
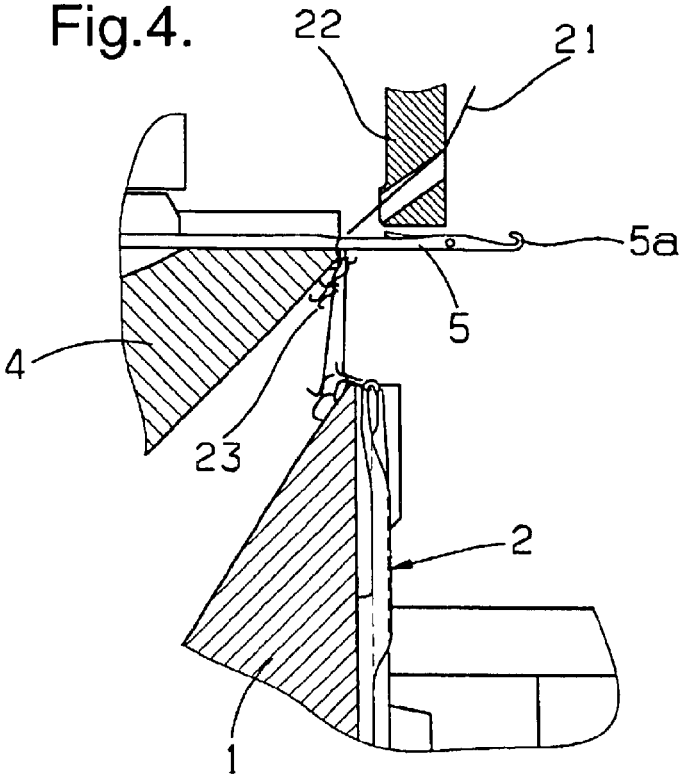
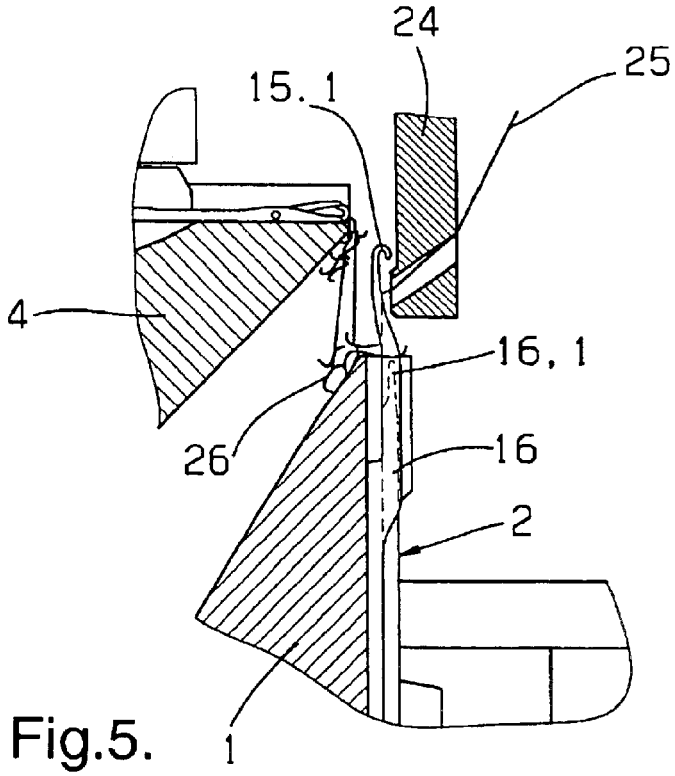
Fig.5.

CIRCULAR KNITTING MACHINE, ESPECIALLY FOR THE PRODUCTION OF SPACER FABRICS

BACKGROUND OF THE INVENTION

The invention relates to a circular knitting machine having a first needle bed in the form of a needle cylinder which has grooves for first knitting needles, a first cam for controlling the first knitting needles, a second needle bed in the form of a dial which has grooves for second knitting needles, and a second cam for controlling the second knitting needles, the two needle beds fixing a vertical and a horizontal comb spacing as well as a stitch spacing.

In circular knitting machines of this type (e.g. DE 41 28 372 A1) three dimensions are fixed by the relative position of the needle cylinder and of the dial, these dimensions being described hereinafter as "axial comb spacing", "radial comb spacing" and "stitch spacing". The axial comb spacing is given by the spacing between the upper end fare or the stitch knocking-over edge of the needle cylinder and the grounds or bases of the grooves which are formed in the dial and which receive the dial needles, whilst the radial comb spacing is provided by the spacing between the outer end face or the stitch knocking-over edge of the dial and the bases of the grooves which are formed in the needle cylinder and which receive the cylinder needles. The two comb spacings defined in this manner finally fix the dimension described as the stitch spacing (or stitch length), which is substantially produced by the spacing between two circular lines, of which the one is provided by the outer circumferential line of the dial at the level of its groove bases and the other is provided by the outer circumferential line of the needle cylinder at the level of its groove bases.

In the production of knitwear, using both the needle cylinder and the dial, it is frequently desired to select values which deviate from the standard values, particularly large values, for the spacings mentioned, especially the stitch spacing. This applies e.g. in the use of circular knitting machines of the type described initially for the production of so-called "spacer fabrics". This term is understood to refer to knitted goods which comprise essentially two fabric webs produced solely with the needles of the needle cylinder or respectively solely with the needles of the dial, these fabric webs being inter-connected by thin intermediate layers (e.g. DE 74 25 934 U1, DE 28 50 823 A1). These intermediate layers are formed in that, between the method steps intended for the production of the two fabric webs, a mostly thin, monofil connecting thread is inserted both into the cylinder needles and into the dial needles and is worked by the latter in the manner of tack stitches. The lengths of the sections of this connecting thread which lie between the two fabric webs and thus also the total thickness of the spacer fabric depend substantially on the size of the stitch spacing and are the larger, the further the two above-mentioned circular lines, which define the stitch spacing, are spaced apart from one another.

When standard circular knitting machines having needle cylinders and dials are used, which are suitable also for other purposes, the stitch spacing is comparatively small, since e.g. the axial comb spacing is a maximum of approx. 5.6 mm and the radial comb spacing is a maim of approx. 1 mm. Even in circular knitting machines in which the axial comb spacing is variable by axial displacement of the dial relative to the needle cylinder, as applies also to the above-mentioned known circular knitting es, the maximum axial comb spacing which can be produced is generally less than 6 mm, whilst the radial comb spacing is fixedly predetermined by the external diameter of the needle cylinder and of the dial at a value of approx. 1 mm.

The small size of the maximum axial comb spacing is, inter alia, a consequence of the latch needles usually used and of the small latch lengths or hinge lengths of latch needles. Since namely on the one hand the connecting thread, when being bound into the tuck position, has to be inserted substantially simultaneously both into the cylinder needles and into the dial needles, and on the other hand during thread take-up the cylinder and dial needles may only be raised at a maximum so far that in so doing the ("old") stitches which are located in their hooks still remain on the open needle latches and do not slide out over the latches onto the needle shafts, the axial comb spacing is substantially limited by the latch length of the knitting needles used. Corresponding limitations arise in respect of the radial comb spacing and in the production of goods other than spacer fabrics.

In connection with the production of spacer fabrics it is already known (US 2002/0152776 A1) to enlarge the stitch spacing by selecting the two comb spacings at least twice as big and preferably three to four times as big as in standard machines. In view of the above explanations, however, this would presuppose that the cylinder needles and/or dial needles can be raised correspondingly far and to this end are provided with correspondingly long latches which despite the increased raising make possible an arrangement of the knitting needles in a tuck position.

The construction of a circular knitting machine taking into account these requirements is possible in principle, but leads to the disadvantage of a comparatively large width of the knitting systems and/or a comparatively low maximum knitting speed. Depending on the speed at which the needle cylinder and the dial are rotated relative to a stationary cylinder cam and dial cam (or the other way round), the raising and take-down curves of the cylinder cam and dial cam may not exceed a pre-selected maximum steepness in order to avoid needle breakages. This inevitably results in a certain minimum width of the individual knitting systems and leads to circular knitting machines which can have, on the circumference of a needle cylinder which has a diameter of 30 inches, at the most approx. 48 knitting systems (approx. 1.6 knitting systems per inch). If for a complete stitch row of a spacer fabric, as is frequently the case, six adjacent knitting systems are required, at the most therefore approx. 8 full stitch rows or sections of knitted fabric can be produced per revolution of the needle cylinder.

It is, therefore, an object of this invention to so design the circular knitting machine of the kind specified above that the disadvantages mentioned above are avoided even if a comparatively large maximum stitch spacing is provided.

Another object underlying this invention is to so design the circular knitting machine mentioned, above that it can be operated with smaller system widths and at higher speeds.

Yet another object of this invention is to provide a circular knitting machine for producing spacer fabrics which machine has a comparatively large maximum stitch spacing and can be operated with smaller system widths and/or at higher speeds.

SUMMARY OF THE INVENTION

These and other objects of the invention are solved with a circular knitting machine comprising a cylinder having cylinder needles, a cylinder cam, a dial with needles and a dial cam. The needle cylinder and the dial fix a vertical and a horizontal comb spacing and a stitch spacing. According to the invention, the needle cylinder and the dial are set up to form a stitch spacing of at least 6 mm, and the knitting needles of the needle cylinder and/or the dial are in the form of compound needles.

The invention proceeds from the idea that, when compound needles are used it ought to be possible to raise their needle parts and thus their hooks at comparable speeds far higher with steeper cams than is possible with latch needles, and in so doing so to control the opening and closing of the hooks with the aid of the slide parts, that the old stitches if necessary form tuck stitches even when the needle parts are raised high without sliding out of the needle hooks. Experiments have confirmed that this assumption is correct and that comb spacings of 14 mm or more may be easily realised with compound needles. In addition to the advantages known per se of compound needles (e.g. DE 38 21 213 C2), there arises thus above all the advantage that the invention leads to a high-performance machine which may be equipped with 72 and more knitting systems for a needle cylinder diameter of 30 inches, and may be operated at speeds which are usual with the machines known previously. The resulting increase in efficiency is 50%.

Further advantageous features arise from the subordinate claims.

BRIEF DESCRIPTION OF THE DRAWINGS

The invention is explained in greater detail below with the aid of an embodiment in conjunction with the accompanying drawings. These show:

FIGS. 4 to 11 schematically, sections through the circular knitting machine of FIG. 1 along lines IV—IV to IX—IX of FIG. 3.

DESCRIPTION OF THE PREFERRED EMBODIMENT

Figure 1:
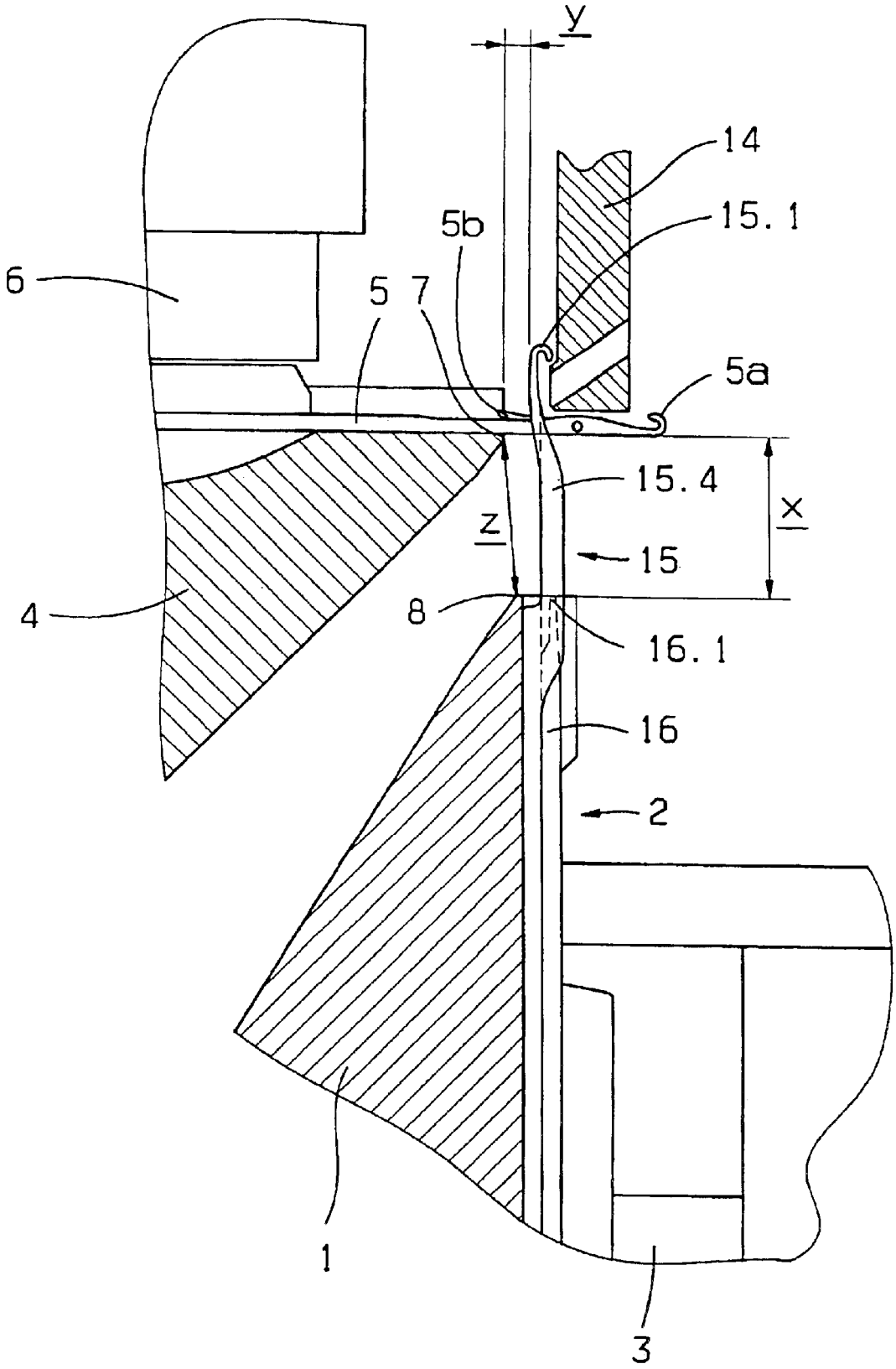
FIG. 1 a schematic longitudinal section through a circular knitting machine according to the invention, which has a needle cylinder and a dial.

According to FIG. 1, a circular knitting machine, represented only schematically, contains a first needle bed in the form of a circulating needle cylinder 1, which is provided with axially parallel grooves which are not shown in greater detail and in which first knitting needles in the form of cylinder needles 2 are mounted so as to be displaceable in a vertical direction. A first cam surrounding the needle cylinder 1 and in the form of a cylinder cam 3 has cam parts which are not shown, which co-operate with butts of the cylinder needles 2, also not shown, in order to provide these with the necessary raising and taking-down movements in an axial direction.

Above the needle cylinder 1 is arranged a second needle bed in the form of a dial 4, which is provided with radial grooves, not shown in detail, which extend perpendicularly with respect to the grooves of the needle cylinder 1 and in which second knitting needles in the form of dial needles 5 are mounted so as to be radially displaceable. Above the dial 4 is arranged a second cam in the form of a dial cam 6, which has cam parts which are not shown and which cooperate with butts of the dial needles 5 which are also not shown, in order to provide these with the necessary raising and taking-down movements in a radial direction.

Moreover it is clear that a plurality of knitting systems is disposed along the circumference of the needle cylinder 1 and the surface of the dial 4, these systems having the necessary cam parts for raising or taking down the cylinder needles and/or the dial needles 2, 5.

In circular knitting machines of this type, for the purposes of the present invention a value x which corresponds to the spacing between an upper end face or stitch knocking-over edge of the needle cylinder 1 and the grounds or bases of the grooves of the dial 4 which receive the dial needles 5, is designated as the vertical comb spacing, and a dimension y between the external end face or stitch knocking-over edge of the dial 4 and the bases of the grooves of the needle cylinder 1 which receive the cylinder needles 2 is designated as the horizontal comb spacing on the other had. Moreover as the stitch length or stitch spacing z is designated a dimension which is provided substantially by the spacing between two circular lines 7 and 8, of which the one is given by the outer circumferential line of the dial 4 at the level of its groove bases and the other is provided by the outer circumferential line of the needle cylinder 1 at the level of its groove bases.

Circular knitting machines of this type and their operation are generally known to the expert, e.g. from the document DE 41 28 372 A1, which is hereby incorporated by reference in the subject matter of the present disclosure to avoid repetitions.

Figure 2:
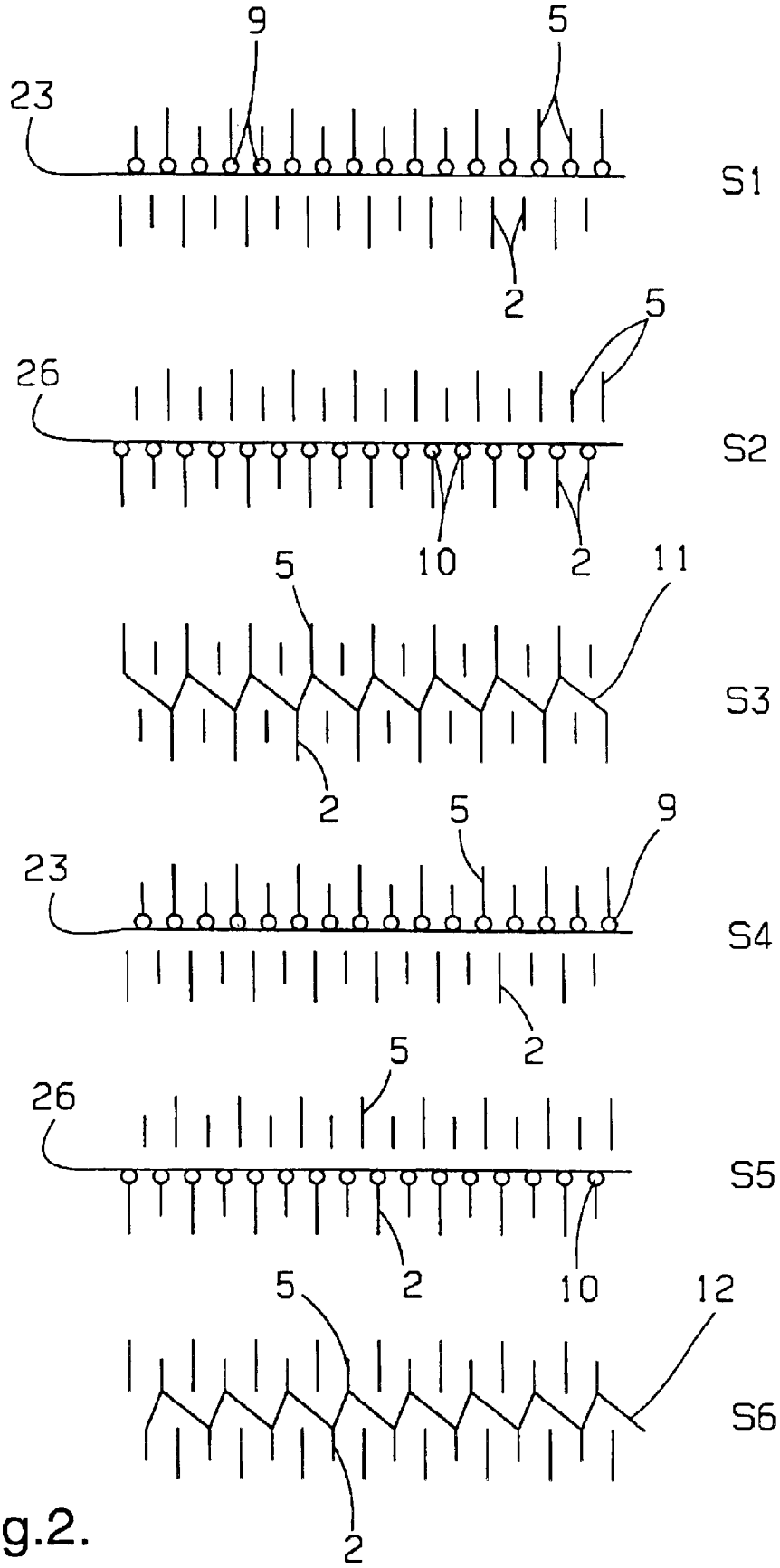
FIG. 2 schematically, the production of a spacer fabric using the circular knitting machine according to FIG. 1.

If a spacer fabric is to be produced with the circular knitting machine according to FIG. 1, it is possible to proceed e.g. as per FIG. 2 in which the cylinder and dial needles 2, 5 are schematically indicated by lines and the stitches formed by the cylinder and dial needles 2, 5 are schematically indicated by circles 9 and 10. In a first method step, or respectively system S1, for example a first thread is taken up solely from dial needles 5 and worked into stitches 9, by which means a fabric web in the form of a rib hose 23 formed on the dial 4 is produced (cf. also FIG. 4). In a second method step, or respectively system S2, a second thread is for example taken up solely by the cylinder needles 2 and worked into stitches 10, by which means a fabric web in the form of a cylinder hose formed on the needle cylinder 1 is produced (cf. also FIG. 5). Finally in a third method step, or respectively knitting system S3, a connecting thread 11 is inserted both into selected cylinder needles and into selected dial needles 2, 5 and worked or laid-in by the latter as a tuck stitch, which is indicated in FIG. 2 by a continuous line. Provision is here made for the connecting thread to be inserted only in every second cylinder and dial needle 2, 5, in each case indicated by a long dash, whilst the cylinder and dial needles 2, 5 represented as short dashes do not pick up the connecting thread 11. Long and short dashes here mean that the associated needles have butts which are spaced at a lesser or greater distance front the needle head and are selected with cam parts associated therewith.

In two additional method steps, or respectively knitting systems S4 and S5, the stitch formation is carried out similarly to knitting systems S1 and S2. On the other hand in a sixth method step, or respectively knitting system S6, the procedure is the same as in knitting system S3 but with the difference that now a connecting thread 12 is only taken up by the cylinder or dial needles 2, 5 indicated by short dashes and worked into a tuck stitch. For a complete cycle or section of the spacer fabric, therefore, six successive knitting systems S1 to S6 are required. However numerous other types of knitting are also possible, as is known to the expert. For the explanation of further details, reference is made to documents DE 74 25 934 U1, DE 28 50 823 A1 and US 2002/0152 776 A1, which are hereby incorporated by reference in the subject matter of the present disclosure. Moreover it goes without saying that the finished spacer fabric comprises two layers or surfaces produced independently of one another which are held together by a third intermediate layer formed with the connecting threads 11, 12.

As FIG. 1 shows, the stitch spacing z determines the length of the sections of the connecting threads 11, 12 extending from the cylinder needles 2 to the dial needles 5 or vice versa, and thus also the thickness of the intermediate layer. In standard machines this thickness is comparatively small since the dimension x is e.g. 5.5 mm and the dimension y is e.g. 1.05 mm. Here on the one hand it is important that standard machines are equipped with latch needles which, as is shown in FIG. 1 with the example of the dial needles 5, have needle hooks 5*a* and pivotal latches 5*b*. In conventional stitch formation, the needle latches 5*b* are therefore pivoted either into the open position clear from FIG. 1 or into a closed position in which they abut against the needle hooks 5*a* and hold these closed. On the other hand it is important that the dial needles 5 if they are to take up jointly with the cylinder needles 2 a connecting thread supplied by a thread guide 14 (e.g. the connecting thread 11 in FIG. 2), may not be raised radially beyond the position clear from FIG. 1, since otherwise the old stitches held by the needle hooks 5*a* would slide under the latches 5*b* onto the shafts of the dial needles 5 and then be worked into a stitch. The formation of tuck stitches, which is produced by the additional insertion of the connecting thread 11 or 12 into a needle hook 5*a*, which also still holds the old stitch, would then be impossible. The same applies to the cylinder needles 2.

In contrast to this, provision is made according to the invention for at least one of the two needle beds, which in the embodiment given by way of example is the needle cylinder 1, to be equipped with compound needles. The cylinder needles 2 are consequently provided with needle parts 15 and slide parts 16 which are displaceable parallel and in a vertical direction relative to one another, the slide parts being mounted to slide in slots in the needle parts 15 (cf. especially FIG. 3). The needle parts 15 have at their upper ends needle hooks 15.1, whilst the slide parts 16 are provided at their upper ends with slide tips 16.1, by means of which they can open or close the needle hooks 15.1 in a manner known per se. The cylinder cam 3 surrounding the needle cylinder 1 has in this case not individually illustrated cam parts, which cooperate with butts of the needle and slide parts 15, 16 which are also not shown, in order to impart to these the necessary movements for opening or closing the needle hooks 15.1 and for picking up threads. Compound needles and their control systems are also known to the expert, so that e.g. document DE 38 21 214 C2 is hereby incorporated in the subject matter of the present disclosure to avoid repetitions.

In an embodiment of the invention which is currently held to be the best, provision is also made to select the vertical comb spacing x, with an unaltered horizontal comb spacing y, substantially larger than in standard machines and give it for example a value of 14 mm which with y=1.05 mm leads to a value of approx. 14.04 mm for the dimension z. No special measures have to be taken to bring this about, as is explained below with the aid of FIGS. 3 to 11.

Figure 3:
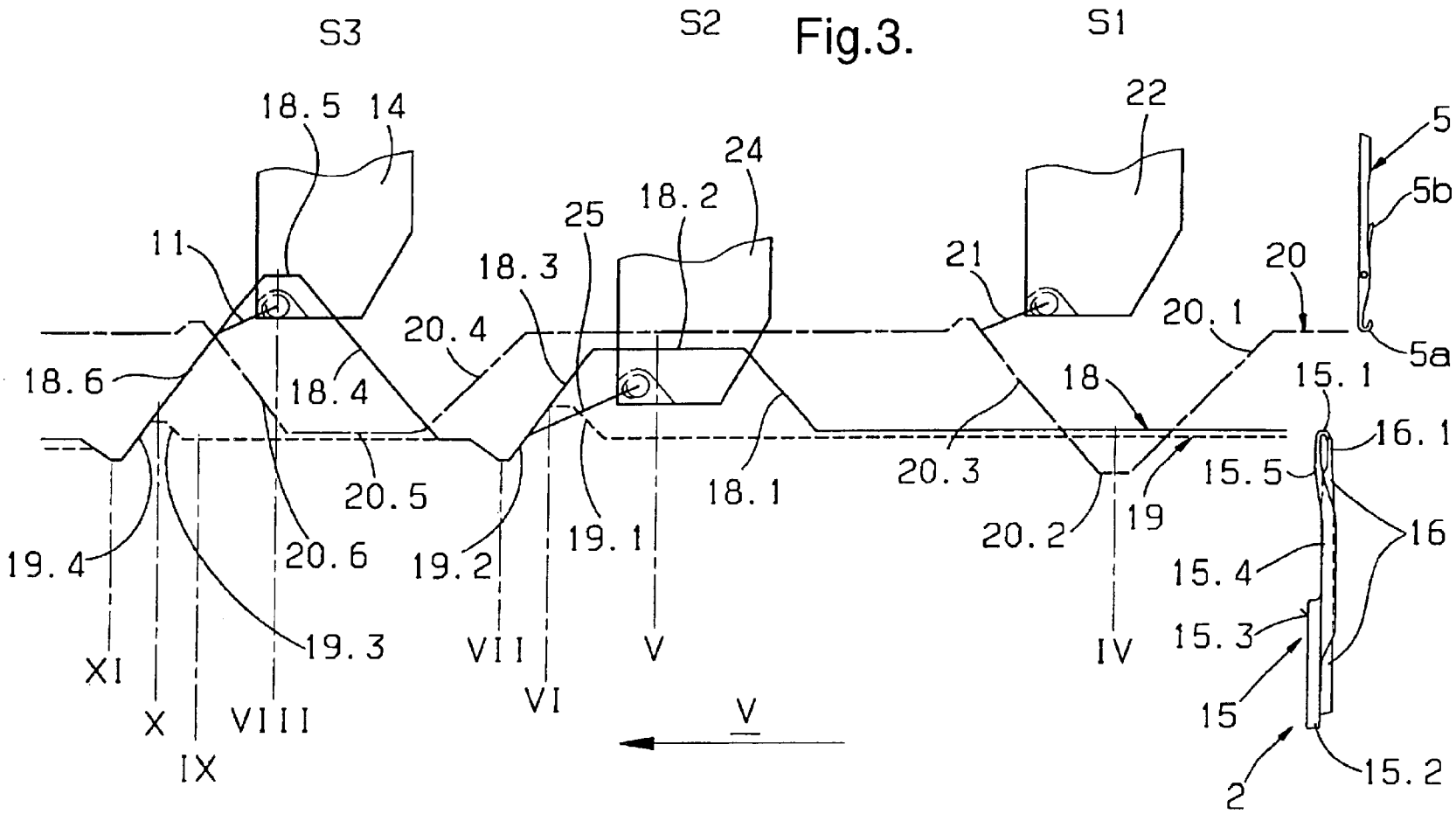
FIG. 3 schematically, the developed view of a cam of the circular knitting machine according to the invention and according to FIG. 1.

According to FIG. 3, the needle part 15 of the compound needle 2 has for example a shaft 15.2 with a rear 15.3 lying on the base of an associated groove of the needle cylinder 1. Adjoining the shaft 15.2 upwards is a breast portion 15.4 which merges into the needle hook 15.1 along a section 15.5 which recedes obliquely towards the rear side. The slot formed in the shaft 15.2 and in the breast portion 15.4 and accommodating the slide part 16 is so configured that the needle part 15 moves to-and-fro between a position in which its hook 15.1 is withdrawn substantially under the upper edge of the needle cylinder 1 (circular line 8) and the raised position clear from FIG. 1 in which the needle hook 15.1 is disposed above adjacent dial needles 5, and the slide part 16 can be held in a position in which the slide tip 16.1 is disposed either according to FIG. 1 directly under the upper edge of the needle cylinder 1, or slightly higher or lower, as is described in more detail further on. Moreover the breast portion 15.4 is configured continuously straight in an axial direction preferably at least at its front side facing away from the needle cylinder 1, in order not to prevent or respectively to make possible the stitch formation explained below.

FIG. 3 shows the exemplary knitting curves for the stitch formations explained with the aid of systems S1 to S3 in FIG. 2, the running direction of the needles 2, 5 being given by an arrow v. Moreover a continuous line 18 represents a curve along which the needle hooks 15.1 of the cylinder needles 2 move. A broken line 19 gives the course of the slide tip 16.1 of the cylinder needles 2. Finally a segmented line 20 shows a path along which the hooks 5*a* of the dial needles 5 move through systems S1 to S3.

On system S1, a row of a rib hose is produced similar to FIG. 2. To this end, the dial needles 5 are pushed forward radially outwards along a path section 20.1, which ends at a path section 20.2 corresponding to the knitting position, in order to open the hooks 5*a*, and thereafter is drawn away radially inwards along a path section 20.3 in order to pick up a thread 2.1 from a thread guide 22, work it hiuo a stitch and thus form a first cloth surface or layer, i.e. a rib hose 23 (FIGS. 2 and 4). The compound needles 2 are held in system S1 in a pass position.

In system S2, the dial needles 5 remain in a withdrawn pass position, whilst the needle parts 15 of the compound needles 2 are initially raised along a path section 18.1. The slide parts 16 here initially remain in a position in which the slide tips 16.1 are disposed below the upper edge (circular line 8 in FIG. 1) of the needle cylinder 1. Thus the needle hooks 15.1 are opened when a path section 18.2 is reached, such that a second thread 25 supplied by a thread guide 24 can be inserted into it when the needle parts 15 are again drawn away along a path section 18.3 and simultaneously the slide parts 16 are initially raised slightly along a path section 19.1 and then, together with needle parts 16, are drawn away along a path section 19.2 in order thus to close the hooks 15.1. In this way, the thread 25 is picked up by hooks 15.1 and worked into stitches, by which means a cloth face or layer is produced on the compound needles 2, i.e. a cylinder hose 26 (FIGS. 2 and 5 to 7).

Figure 8:
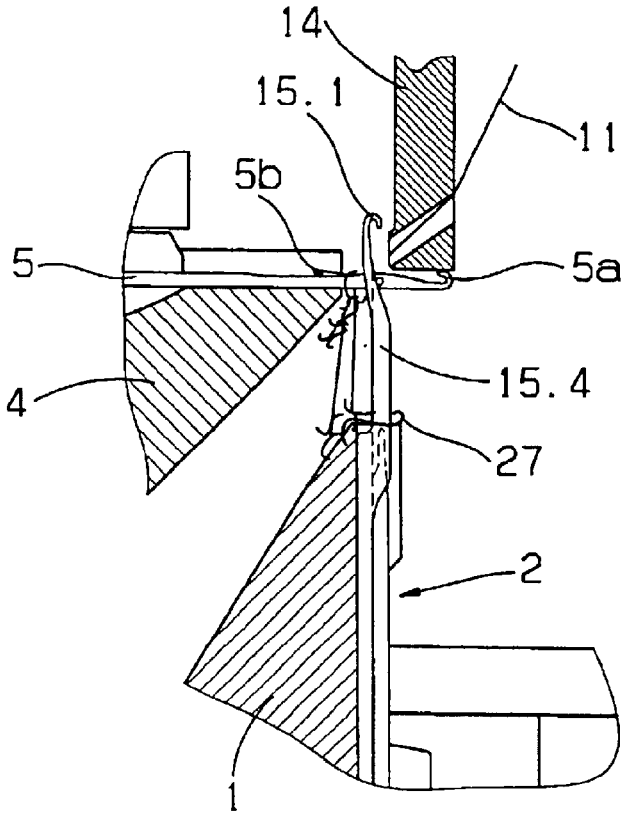

Later on, first the dial needles 5 are raised in system S3 along a path section 20.4 which ends at a path section 20.5 corresponding to the tuck position. At a slight delay thereafter, the needle parts 15 are raised along a path section 18.4 until a path section 18.5, corresponding to the tack position, is reached. The slide parts 16 here still remain in their low position drawn back under the upper edge of the needle cylinder 1 (FIG. 8). However in this position the slide tips 16.1 are in a central region of the breast portion 15.4 in such a way that they also still below old stitches 27 hanging on the breast portions 15.4 and formed in a previous system. Further it is to note, that the cylinder and dial needles 2, 5 may be selected in system S3 in accordance with FIG. 2, whereas the non-selected needles remain ran-through or pass position, not shown.

As in particular FIG. 8 shows, on the one hand the needle parts 15 are raised into such a high position that their hooks 15.1 are disposed above the plane of the dial needles despite the large comb spacing x. On tee other hand the dial needles 5 are pushed forward so far radially outwards that their hooks 5*a* stand on the front sides of the cylinder needles 2. Therefore the connecting thread 11 (cf. also FIGS. 1 and 2) can be inserted simultaneously into both types of needles, as FIG. 8 shows, which purpose the thread guide 14, also visible in FIG. 1, serves.

Figure 9:
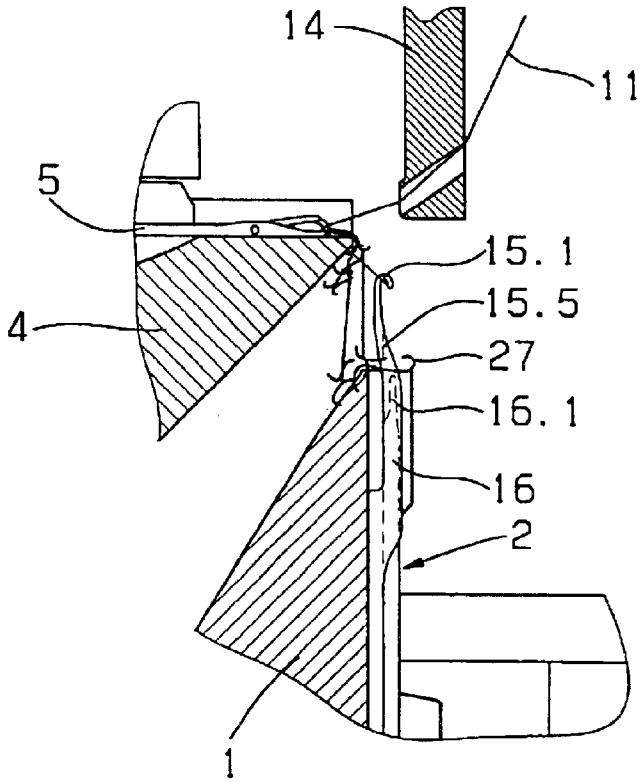

The needle parts 15 and with them the hooks 15.1 are now drawn down again along a path section 18.6 whilst substantially at the same time the dial needles 5 are withdrawn along a path section 20.6. In this process, as in particular FIG. 9 shows, the slide parts 16 remain in their withdrawn position until the old stitches 27 reach the sections 15.5 of needle parts 15 (FIG. 3) which are located between the breast portions 15.4 and the hooks 15.1 and extend at an angle towards the rear sides, and are drawn towards the rear sides of the needle parts 15 by the pull of the cylinder hose 26. Unlike in the formation of stitches, the slide parts 16 are only raised along a path section 19.3 (FIGS. 3 and 10) when the old stitches 27 lie securely on the inner sides of the slide tips 16.1.

Figure 6:
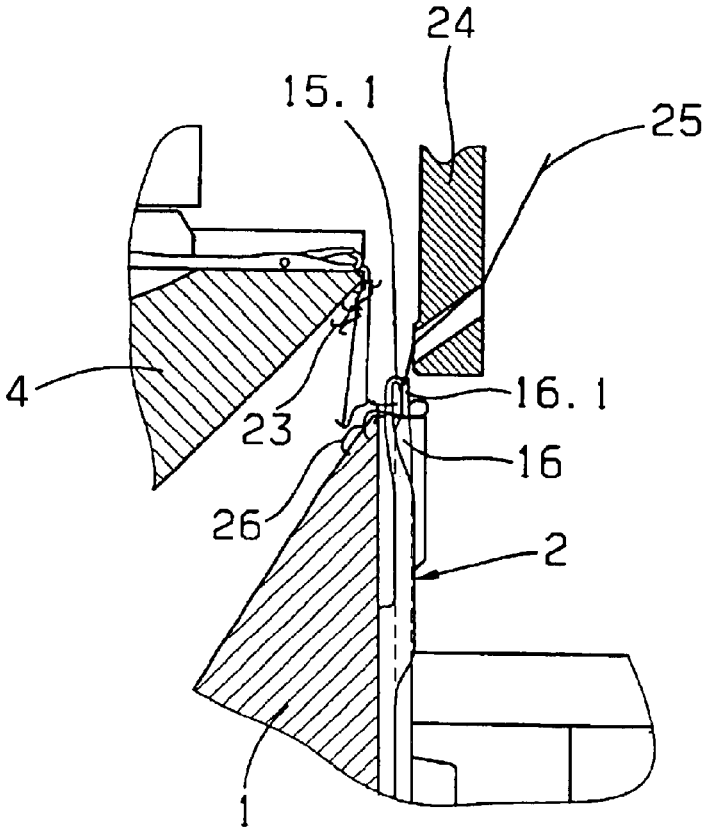
Figure 7:
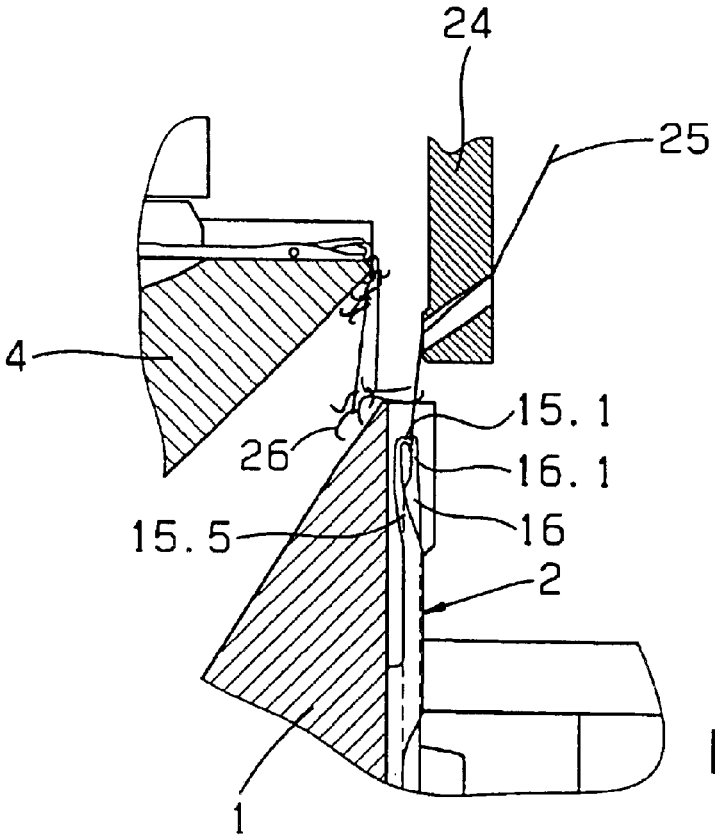
Figure 10:
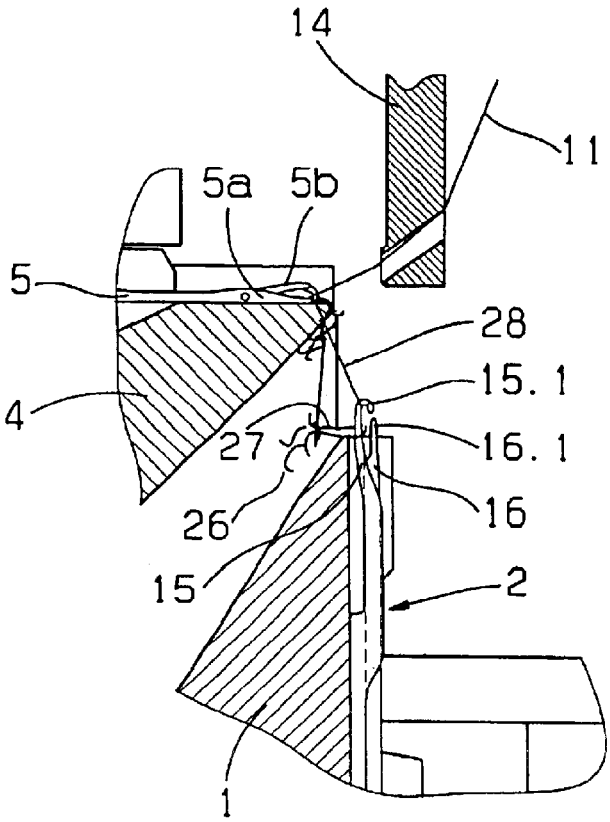
Figure 11:
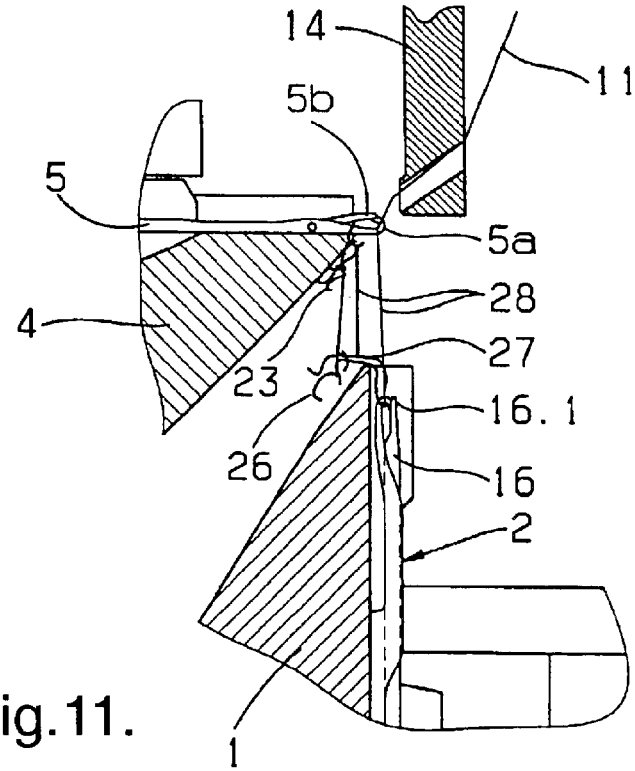

Therefore the old stitches 27, in contrast to FIGS. 6 and 7, are not thrown off but, as the needle parts 15 continue to be drawn away, are conveyed along path section 18.6 back into the needle hooks 15.1 (FIG. 11). Therefore at the end of path section 18.6, both the old stitches 27 and loops 28 of the newly inserted thread 11 are located in hooks 15.1, as is usual in tuck constructions (FIGS. 10 and 11). Correspondingly, the dial needles 5 are so drawn away along path section 20.6 that the loops 28 of the insertion thread 11 are bound in their hooks 5*a* as tuck stitches, and long thread loops 28 are produced which extend between knitted hoses 23 and 26. Then the needles 2 and 5 are returned to their basic position (FIG. 11) such that in a subsequent system S4 (FIG. 2) the described processes can be repeated.

What was explained with the aid of FIGS. 3 to 11 for a circular knitting machine having a large comb spacing x, can be realised correspondingly in a circular knitting machine having a large comb spacing y, by the diameter of the dial 4 being selected sufficiently small. In this case, the dial needles 5 would be formed as compound needles. It would naturally also be possible to provide a large stitch spacing X in that both the cylinder and the dial needles are formed as slide needles and both the vertical and the horizontal comb spacings x or y are selected larger than usual.

In all the cases described, the particular advantage is achieved th the system width can be kept relatively small as a result of the use of compound needles, and that, when customary speeds are used, system widths of 2.4 systems per inch of the needle cylinder diameter can easily be realised, which corresponds to a system width of approx. 33 mm when measured in the circumferential direction. This is exploited according to the invention in order to equip the circular knitting machine with more than 48, preferably at least 72, knitting systems.

The invention is not limited to the described embodiment but can be modified in many ways. This is true for example for the needle cams described with the aid of FIG. 3 which can be altered e.g. in that the needle parts 15 in system S2 are raised to the same height (cf. path section 18.5) as applies to system S3. Furthermore, the designation "compound needle" is intended also to include modified compound needles (e.g. U.S. Pat. No. 1,385,929, U.S. Pat. No. Re 15,741). Finally it goes without saying that the various features can also be applied in other combinations than those described and illustrated.

It will be understood, that each of the element; described above or two or more together, may also find a useful application in other types of construction differing from the types described above.

While the invention has been illustrated and described as embodied in a circular knitting machine, it is not intended to be limited to the details shown, since various modifications and structural changes may be made without departing in any way from the spirit of the present invention.

Without further analysis, the forgoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. Circular knitting machine, comprising: a first needle bed in the form of a needle cylinder (1) hang grooves in which first knitting needles (2) are slidably mounted, a first cam for controlling said first knitting needles, a second needle bed in the form of a dial (4) having grooves in which second knitting needles (5) are slidably mounted, and a second cam (6) for controlling said second knitting needles (5), wherein said two needle beds (1, 4) fix a vertical and a horizontal comb spacing (x, y) as well as a stitch spacing (z), said stitch spacing (z) has a value of at least 6 mm and said knitting needles (2) of at least one needle bed (1) are configured as compound needles having hooks (15.1).

2. Circular knitting machine according to claim 1, wherein said stitch spacing (2) of at least 6 mm is achieved predominantly by a correspondingly large axial comb spacing (x) and said first knitting needles (2) are configured as compound needles.

3. Circular knitting machine according to claim 1 or 2, wherein said two cams (3, 6) are so configured that both said first knitting needles (2) and said second knitting needles (5) may be brought into a tuck position, wherein said first and second needles have hooks (15.1, 5*a*) and wherein said hooks of said first needles (2) are arranged above said second knitting needles (5) in said tuck position.

4. Circular knitting machine according to claim 1 or 2, wherein said two cams (3, 6) are so configured that both said first knitting needles (2) and said second knitting needles (5) may be brought into a tuck position, wherein said first and second needles have hooks (15.1, 5*a*) and wherein said hooks of said second needles are arranged in front of said first knitting needles (5,2) in said tuck position.

5. Circular knitting machine according to claim 1 or 2, wherein said first and said second knitting needles (2, 5) are configured as compound needles.

6. Circular knitting machine according to claim 1 or 2, wherein a large number of knitting systems (S1 to S6) are associated with the two needle beds (1, 4), a width of these systems being smaller than corresponds to 1.6 systems per inch of a needle cylinder diameter.

* * * * *